United States Patent [19]

Maryonovich et al.

[11] 4,359,207

[45] Nov. 16, 1982

[54] EMERGENCY STOP MECHANISM FOR THE PAYLOAD OF A LIFTING MECHANISM

[75] Inventors: Michael C. Maryonovich, White Fish Bay; Edward Ebey, Nashota, both of Wis.

[73] Assignee: Fulton Manufacturing Corporation, Milwaukee, Wis.

[21] Appl. No.: 201,507

[22] Filed: Oct. 28, 1980

[51] Int. Cl.[3] ..... B66D 1/54; B66D 5/32

[52] U.S. Cl. ..... 254/272; 187/81; 198/320; 254/334; 254/387; 254/391

[58] Field of Search ..... 254/272, 277, 387, 334, 254/335, 336, 325, 326, 327, 391, 392; 187/22, 71, 81; 104/173 R, 173 ST, 174, 175, 183; 198/320

[56] References Cited

U.S. PATENT DOCUMENTS

| | | | |
|---|---|---|---|
| 105,177 | 7/1870 | Copeland | 187/71 |
| 1,197,529 | 9/1916 | Miller | 187/71 |
| 3,612,486 | 10/1971 | Martin et al. | 254/277 X |
| 3,704,017 | 11/1972 | Young | 187/81 X |
| 3,866,718 | 2/1975 | Hiergeist | 187/71 X |

*Primary Examiner*—John M. Jillions

*Attorney, Agent, or Firm*—Stephen Krefman

[57] ABSTRACT

An emergency stop mechanism for a lifting device capable of moving a load along a predetermined path against and with the force of gravity using a primary cable. The emergency stop mechanism includes a secondary cable or line functionally in parallel with the primary cable. The secondary cable is attached to the load and is wound around an idling drum, with means provided to keep the secondary cable taut around the idling drum. In the event of a failure of the primary lifting system, a braking assembly, sensing and actuated by a decrease in tension in the primary cable, arrests the rotation of the idling drum and thus stops or slows the descent of the payload.

21 Claims, 6 Drawing Figures

17
13
101
51
40
106
36
48
38
104
105
50c
52
50a
44
46
42
74
76
100
85
50
52
68
4
4

EMERGENCY STOP MECHANISM FOR THE PAYLOAD OF A LIFTING MECHANISM

BACKGROUND OF THE PRESENT INVENTION

The present invention relates to safety devices for lifting mechanisms, and more particularly to emergency stop mechanisms for lifting mechanisms using winch-powered cables or lines. Such lifting devices are well known and in common use, for example in elevators, dumbwaiters and in scissors mechanisms for raising industrial or agricultural equipment.

Such lifting mechanisms often consist of a winch operated cable or line, a pulley system and a trolley or traveling member. The trolley may be a sliding member or, as in the case of an elevator, a vertically translating platform or the payload itself. Frequently, the failure of any component of the lifting mechanisms will result in a loss of tension in the cable or line and, therefore, in an absence of lifting force to counteract the force of gravity. The outcome of such a failure may be undesired rapid downward movement of the payload.

Strengthening some of the individual components of the lifting mechanism may increase the reliable operation of the system and greatly reduce the chance of mechanical failure, but there are practical limitations of cost and size to such strengthening. Furthermore, the lifting mechanism will be only as reliable as its weakest component and the reliable operation of the lifting mechanism can be significantly affected only if all the components are strengthened.

Providing a complete second and redundant lifting mechanism is another alternative, but an extremely costly one. Furthermore, repeated use of the parallel lifting mechanism places the same loads on the backup mechanism as on the primary mechanism, thus evenly wearing components of both mechanisms. When one of such mechanisms fails from age, misuse, or faulty maintenance, the other mechanism will probably also be in a weakened state. The increased load suddenly placed on the surviving mechanism could cause it to fail also, thus releasing the payload.

Many attempts have been made at designing safety devices to prevent the free fall of the payload of lifting mechanisms, some particularly well suited to mechanisms lifting extremely heavy or extremely fragile payloads and others designed for a lifting mechanism moving the payload up and down along a stationary vertical shaft. U.S. Pat. No. 1,072,362, for example, disclosed an example of a safety mechanism for mine cages having guide ropes wherein a clutch normally restrained by the tension of the winding line grips the ropes in the event of a drop in tension in the winding line. Devices such as those disclosed in U.S. Pat. Nos. 2,483,828 and 2,747,690 use clutches or brake rods to grip the wall of a shaft. Such devices work well for the type of lifting mechanisms for which they are designed, but are needlessly expensive and complex for many applications. For example, in a scissors mechanism of an agricultural grain auger and in devices for lifting small, inexpensive, or lightweight payloads, particularly those lifted without a vertical shaft, such devices would be commercially impractical.

The object of the present invention, therefore, is to provide an inexpensive, easy to manufacture and reliable safety device for cooperation with an active lifting mechanism, which device will secure the payload and mechanism in its raised position or slow its descent in the event of a failure of the primary lifting system, but which safety device sustains minimal loads and thus a minimum of wear during normal operation.

SUMMARY OF THE INVENTION

The present invention provides an inexpensive emergency stop mechanism for stopping or slowing the descent of the payload of a lifting mechanism having a winch operated primary cable or line attached to a trolley or traveling and lifting member, and wherein the primary cable accomplishes a lifting function by pulling the trolley in the direction of increased potential energy. The emergency stop mechanism comprises a secondary cable or line functionally in parallel with the primary cable with respect to the path of trolley movements. One end of the secondary cable is attached to the trolley. The secondary cable leads from the trolley and is wound around an idling drum, leads from the idling drum to and about a pulley and from the pulley leads to and is fastened to the trolley. A braking means is actuated by a decrease in tension in the primary cable and responds to such decrease by arresting the rotation of the idling drum. The braking means preferably comprises a gear coupled to the idling drum for rotation therewith, and a pawl pivotable into engagement with the gear.

DESCRIPTION OF THE DRAWING

FIG. 3 is an enlarged side elevational view of the emergency stop mechanism and a portion of the lifting mechanism;

DETAILED DESCRIPTION OF THE PREFERRED EMBODIMENT

Refer now to the drawings, wherein an agricultural grain auger having a lifting mechanism with an emergency stop mechanism according to the present invention is illustrated. The grain auger and the winch of the lifting mechanism for the grain auger illustrated and described are part of the prior art and form no part of the present invention which resides in the emergency stop mechanism and in the alteration of the lifting mechanism to accommodate the emergency stop mechanism.

Figure 1:
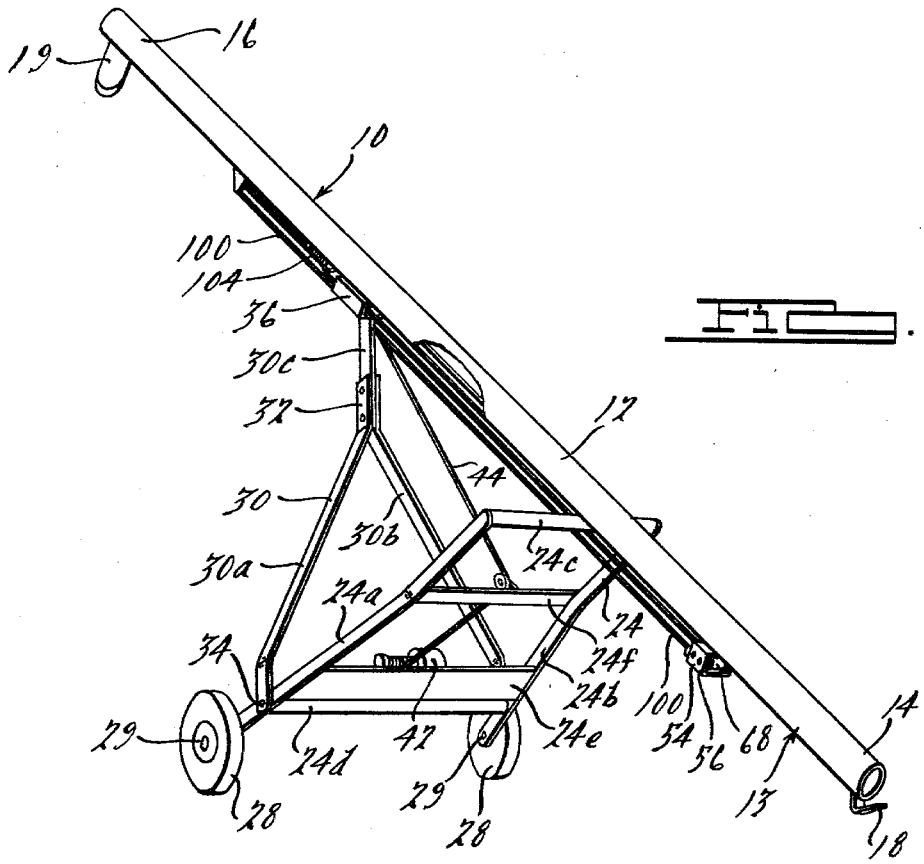
FIG. 1 is a perspective view with portions cutaway of an agricultural grain auger having a lifting mechanism with an emergency stop mechanism according to the present invention.
Figure 2:
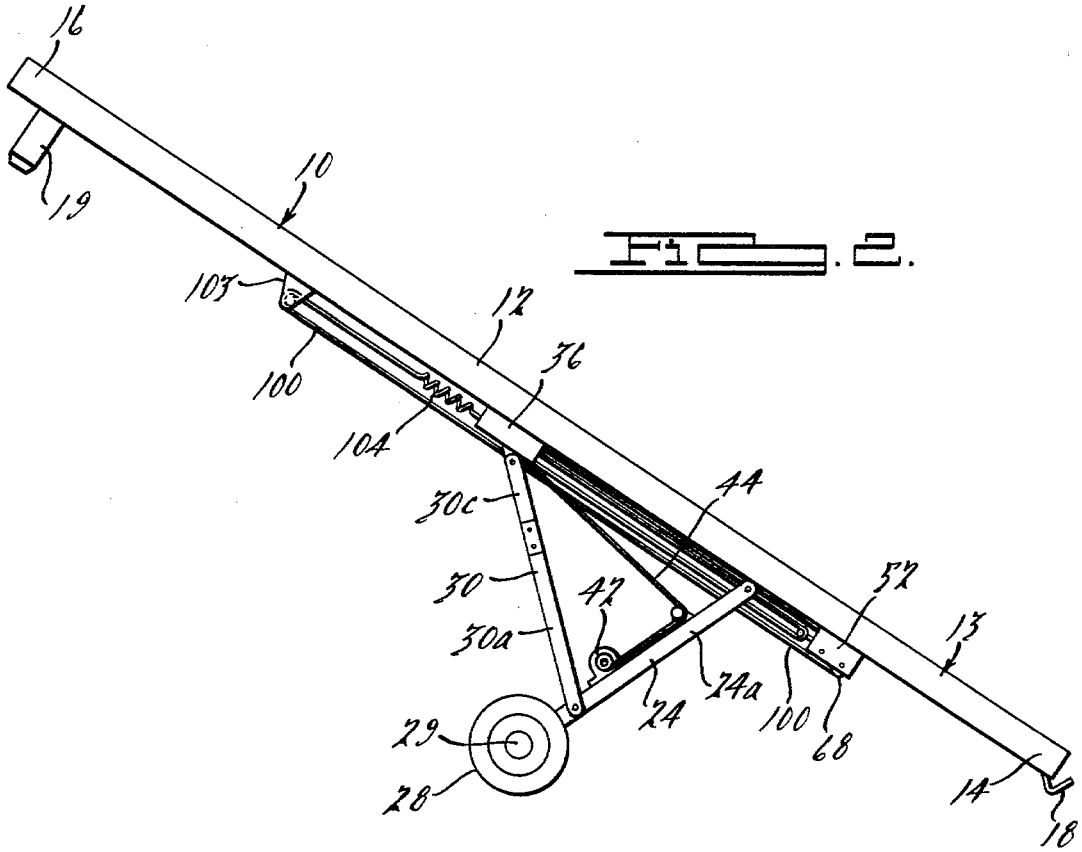
FIG. 2 is a side elevational view thereof.
Figure 2:
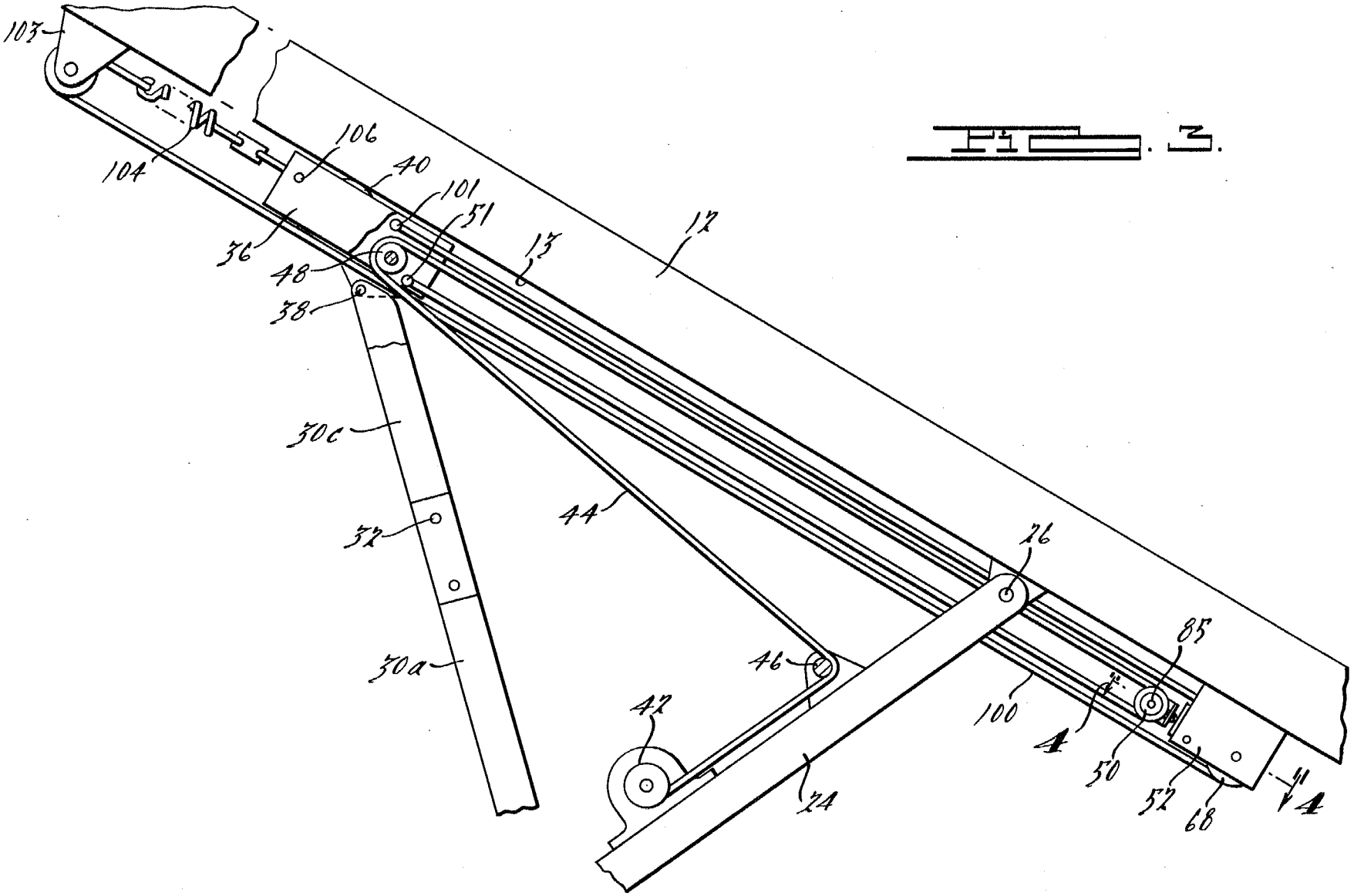

As shown in FIGS. 1, 2 and 3, an agricultural grain auger has a long cylindrical main body 12 with a longitudinal internal bore extending therethrough. Conventionally, a long screw mechanism, not shown, for delivering grain from the lower end 14 to the upper end 16 of the auger is positioned within this bore. A leg 18 is mounted to the lower end 14 of the main body to support the main body on the ground. A spout 19 is located at the upper end 16 of the main body 12 whereby grain delivered by the screw mechanism may be dropped into a grain bin, not shown. A lifting mechanism is provided on the underside 13 of the main body 12 such that the grain auger 10 may be stored and transported in a compact horizontal position, and such that the upper end 16 and thus the spout 19 may be adjusted as needed to a height just above the top of the particular grain bin to be loaded.

The lifting mechanism for the grain auger 10 comprises three major subassemblies discussed in detail below: a scissors mechanism, a lifting actuation mechanism and an idling emergency stop mechanism.

The scissors mechanism, best shown in FIGS. 1 and 2, has a first frame 24 including a square shaped element having side members 24*a* and 24*b* and base members 24*c* and 24*d*. Additional cross members 24*e* and 24*f* extend between side members 24*a* and 24*b* parallel to base member 24*c* and add rigidity to the frame 24. The members of frame 24 may be secured together by welds or by appropriate fasteners such as screws, bolts, or rivets. The frame 24 is pivotally connected at the midpoint 26 (FIG. 3) of its member 24*c* to the underside 13 of the grain auger main body 12. Each of a pair of wheels 28 is rotatably attached at the lowermost end of each of the side members 24*a* and 24*b* by a pin or a stub shaft 29.

The scissors mechanism further has a second frame 30 comprising an inverted Y-shaped member. The frame 30 has two diverging arm members 30*a* and 30*b* connected to one leg or base member 30*c* by rivets 32. The lowermost ends of the frame members 30*a* and 30*b* of the second frame 30 are pivotally fastened to the frame members 24*a* and 24*b* respectively of the first frame 24 by bolts 34.

A traveling lifting member or trolley 36 is pivotally fastened to the leg member 30*c* of link 30 by means of pin 38. As will be described later in detail, the weight of the raised grain auger rests upon the trolley 36. A wheel 40 is secured to the trolley 36 by means of a stub shaft, not shown, for rolling movement along the underside 13 of the grain auger main body 12.

The lifting mechanism best shown at FIGS. 2 and 3, comprises a winch-powered cable, block, and pulley system. A schematically illustrated winch 42 is mounted to cross member 24*e* of the frame 24. The winch 42 may be operated manually or hydraulically or may be powered by an electric motor or a fuel burning engine and may be selected from the many winches well known in the art. The winch 42 plays out and retrieves a primary cable or line 44. The primary cable 44 leads from the winch 42 to and about a pulley 46 pinned or bolted to cross member 24*e* of the frame 24. In conventional prior art grain auger lifting mechanisms, the cable 44 may extend from the pulley 46 to the trolley 36 and is fastened thereto. As shown, however, the primary cable 44 extends from pulley 46 to and around a second pulley 48 fastened to the trolley 36. The cable 44 extends from the pulley 48 to and about a third pulley 50 mounted to a drum and brake assembly 52 of the emergency stop mechanism. The end of the cable 44 remote from winch 42 is fastened at 51 to the trolley 36.

Figure 4:
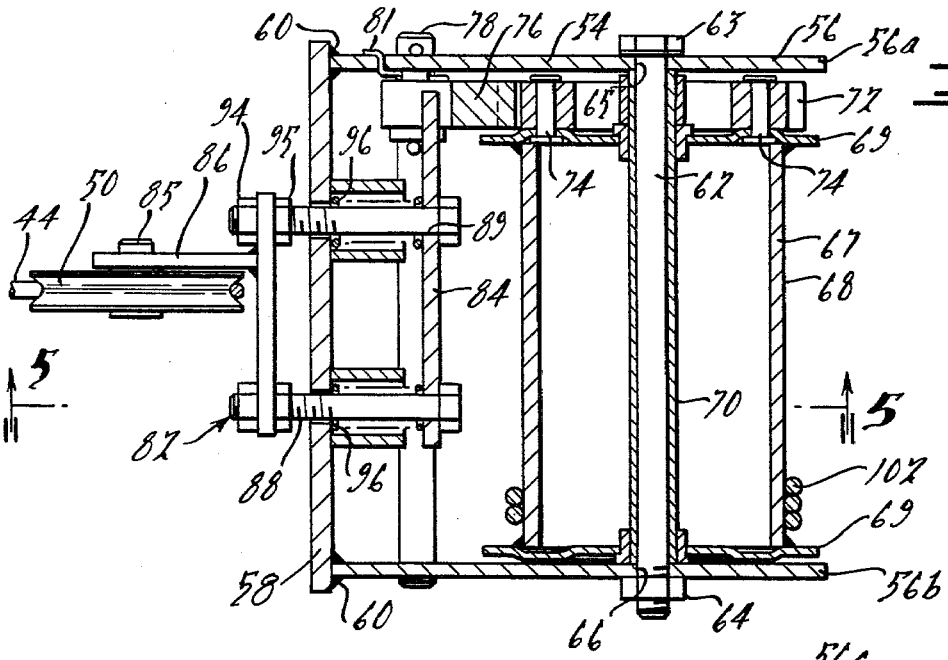
FIG. 4 is a sectional view of the idling emergency stop mechanism assembly thereof taken along line 4—4 of FIG. 3.
Figure 5:
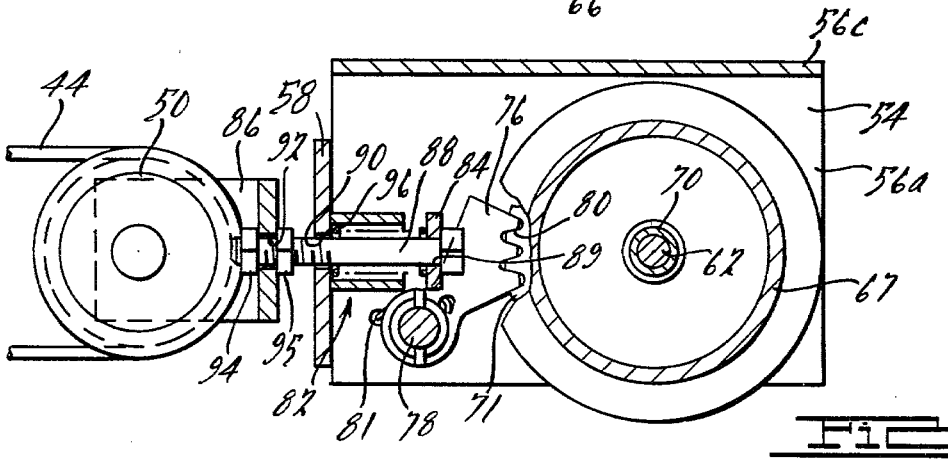
FIG. 5 is a sectional view taken along line 5—5 of FIG. 4.

The emergency stop mechanism is best shown at FIGS. 3, 4, and 5, and comprises an idling cable and brake mechanism arranged functionally in parallel with the primary lifting mechanism described in the preceeding paragraph. The emergency stop mechanism includes an idling drum and brake assembly 52 having a frame 54 mounted on the underside 13 of the grain auger main body 12 proximate the lower end 14 of the grain auger 10. The frame 54 includes a U-shaped stamping 56 having sidewalls 56*a* and 56*b* and a top wall 56*c*. One or more bolts, not shown, secure the top wall 56*c* to the underside 13 of the grain auger main body. The frame 54 further has a flat front plate 58 welded, as shown at 60, to the sidewalls 56*a* and 56*b* of the stamping 56.

A bolt 62 passes through holes 65 and 66 in the sidewalls 56*a* and 56*b* respectively and thus is secured parallel to the top wall 56*c* and front plate 58. The head 63 of the bolt 62 rests against sidewall 56*a*. Nut 64 engages the threaded end of bolt 62 and secures it in place. An idling drum 67 and a gear 70 are mounted on the bolt 62 which functions as a shaft about which drum and gear can rotate in unison. The idling drum 67 has an outer cylindrical line winding surface 68, a pair of disk-shaped sidewalls 69 and an inner sleeve 70. The drum 68 and a gear 72 are connected by a plurality of riverts 74 passing through one of the drum sidewalls 69 and the gear 72 to rotate together about the bolt.

A second pair of apertures in sidewalls 56*a* and 56*b* of the frame 54 are provided for mounting a shaft 78. A pawl 76 having a plurality of teeth 80 is pivotally supported on shaft 78 and is movable into and away from engagement with the teeth of the gear 72. A torsion spring 81 engages the pawl 76 and sidewall 56*a* and partially is wound about the shaft 78. Spring 81 exerts a force biasing the pawl 76 away from engagement with the gear 72.

A brake actuator assembly 82 is mounted to the front plate 58 of the frame 54 of the brake and drum assembly 52. The brake actuator assembly 82 includes the pulley 50, referred to earlier in this description as part of the primary lifting mechanism. The pulley 50 is secured to a bracket 86 by means of pivot pin 85 and is mounted outside of the frame 54 of the brake and drum assembly 52 with the pivot pin 85 of the pulley parallel to the front plate 58.

The brake actuator assembly 82 further comprises an actuating plate 84 within the idling assembly frame 54. The activating plate 84 is positioned parallel to the front plate 58 and adjacent to the side of the pawl 76 that is remote from gear 70; which side of pawl 76 hereafter is referred to as the "backside" of the pawl. Each of a pair of bolts 88 passes through one of a pair of apertures 89 in the actuating plate 84 and through one of a pair apertures 90 in the front plate 58 and through one of a pair of apertures 92 in the bracket 86. Each of the bolts 88 are fastened to the frame 86 of the pulley by a pair of nuts 94 and 95.

Two compression springs 96 are disposed between the actuating plate 84 and the front plate 58 of the frame 54, each spring being wound about the shank of one of the bolts 88. The compression springs 96 bias the actuating plate 84 toward the backside of the pawl 76.

In order to assure proper operation of the brake actuator, as will become apparent shortly, the deflection characteristics of compression springs 96 are important. Springs 96 are selected so that the force transmitted to the springs 96 from the tension in the primary cable 44 through the brake actuator assembly 82 causes sufficient compression of the springs 96 to permit the torsional spring 81 to bias the pawl 76 away from engagement with the gear 72. Springs 96 must, however, in the event of a large drop in tension along the cable 44, transmit sufficient force through plate 84 to the backside of the pawl 76 to overcome the force exerted on the pawl by the torsional spring 81 and drive the pawl into engagement with the gear.

The emergency stop mechanism further comprises a secondary cable or line 100, best illustrated at FIG. 3. The secondary cable 100, is fastened at one of its ends 101 to the side of trolley 36 proximate brake actuator 23. The cable 100 extends from the trolley 36 and is wound a plurality of turns around the winding surface 68 of the idling drum 67. It has been found experimentally that use of three windings, as shown at 102 in FIG. 4, is satisfactory. The cable 100 extends from the idling drum 68 to and about a pulley 103 and is fastened to a compression spring 104. The spring 104 is fastened at 106 to the trolley 36 and maintains tension in the cable 100 and thus the desired magnitude of friction between the windings of cable 100 and surface 68 of drum 67.

In operation, the force of gravity urges the grain auger 10 towards a position of lower potential energy. Thus, the weight of grain auger 10 tends to urge the trolley 36 upwardly along the underside 13 of the grain auger main frame 12. The grain auger 10 may therefore be lowered by operating the winch 42 raised by operating the winch 42 to retrieve the primary cable 44, thereby pulling the trolley 36 downwardly along the underside 13 of the auger main frame 12 and drawing the two links 24 and 30 together.

During normal operation, the tension in the primary cable 44 and the force of the torsional spring 81 are sufficient to counteract the combined force of two springs 96 on the brake actuator 82 and therefore to bias the actuator plate away from the pawl. Thus, in normal operation, the idling drum 67 freely rotates to allow the secondary cable 100 to wind and unwind about the line winding surface 68.

As can be seen from the preceeding description, in the absence of an emergency backup mechanism, the failure of the winch 42, the pulley 46 or the cable 44, or the failure of any of the fasteners holding these components to the grain auger would result in an absence of any force counteracting gravity and will thus allow the grain auger to descend in an undesirable sudden movement. The emergency stop mechanism of the present invention takes advantage of the fact that the failure of any of these components results in a decrease in tension in the primary cable 44. The decrease in tension along the primary cable results in a net force on the actuator 82 in the direction of the pawl 76. The compression springs 96 biases the actuating plate 84 against the backside of the pawl 78 and thus causes rotation of pawl 76 in the clockwise direction as illustrated (in the drawing) towards the gear 72 overcoming the weaker force of the torsion spring 81. The teeth 80 of the pawl 76 arrest the rotation of the gear 72 by engagement with the teeth of this gear, and thus also arrest movement of the drum 67. The motion of the secondary cable 100 is thereby retarded, which in turn retards the upward motion of the trolley 36 and the downward motion of the grain auger 10.

As previously noted, the secondary cable 100 is preferably wound a plurality of times around the line winding surface 68 of the idling drum 67. This is done to reduce slippage of the cable against the drum. Since the frictional force between the cable 100 and the line winding surface 68 increases as the length of line in contact with the drum increases, slippage of the cable 100 is reduced by increasing the number of turns or by increasing the diameter of the drum 67. Use of an excessive number of windings, however, is to be avoided since there is a greater chance of the windings crossing and thus a binding condition preventing rotation of the drum during normal operation. It has been found that for use with a grain auger lifting mechanism of the type herein described, three windings or turns of cable work well. Note that the compression spring 104 keeps the secondary line 100 taut and thus further increases the frictional force and reduces slippage of the cable.

Some slippage of the line with respect to the drum will occur and may be desirable. The emergency stop mechanism may be designed to allow sufficient slippage so that the descent of the grain auger is not stopped, but is drastically decelerated so that it is slowly lowered to the ground. Alternatively, less slippage may be permitted, for example, by providing more windings. Even in the later case, however, some slippage will allow the line to safely absorb sudden downward forces without a great risk of the secondary cable breaking due to shock loading.

Figure 6:
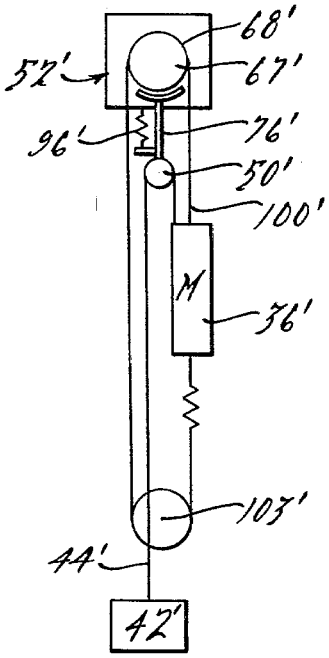
FIG. 6 is a schematic illustration of the general principle of the emergency stop mechanism of the present invention.

FIG. 6 schematically illustrates the emergency stop mechanism of the present invention. FIG. 6 is furthermore provided to illustrate how the emergency stop mechanism of the present invention may be used for other types of lifting mechanisms, such as dumbwaiters and elevators. The lifting mechanism consists of a winch 42' and a cable or line 44'. The line 44' extends from the winch 42' to and about a pulley 50' coupled to a brake actuator assembly 52'. The end of line 44' is fastened to the trolley, in this case a platform 36'. The actuator 52' comprises a spring loaded brake shoe 76' for engagement with a braking surface on an idling drum 67'.

The secondary system, or emergency stop mechanism comprises a secondary line 100' connected at one end to the top of the platform 36'. The other end of line 100' is wound a plurality of turns around the winding surface 68' of the drum 67'. The line 100' then leads from the drum 67' to and about an idling pulley 103' on the ground, and is fastened to the underside of the platform 36'. In the event of a failure of the primary system and thus a drop in tension along the primary line 44', the brake shoe 76' is driven by a spring 96' to engage the braking surface of the drum 67' and arrest its rotation. The secondary cable 100' thus decelerates or stops the free fall of the platform 36' in a manner directly analogous to the secondary cable 100 of the stop mechanism of the grain auger 10 described earlier.

The foregoing detailed description represents the best mode contemplated at the time of filing for carrying out the present invention. From the foregoing it is apparent that the present invention provides an inexpensive safety device cooperating with an active lifting mechanism, which device secures the payload in its raised position or, alternatively, slows its descent, in the event of a failure of the primary lifting mechanism. The safety device of the present invention sustains minimal loads and thus minimal wear during normal operation.

Other variations not departing from the spirit of the above described invention will be apparent to those skilled in the art. For example, the primary cable and the secondary cable may, depending on the application, comprise any type of line, rope, chord, twine, string, or chain of appropriate strength. Furthermore the emergency stop mechanism of the present invention may be used with other types of lifting mechanisms, such as dumbwaiters, platform elevators, portable and stationary grain augers, and portable and stationary chain and flight elevators. These and other variations can be carried out without departing from the scope of the invention which is intended to be limited only by the scope of the appended claims.

What is claimed as novel is as follows:

1. An emergency stop mechanism for a lifting device capable of moving a load against and with the force of gravity and having a primary cable, said cable exerting a force on said load opposing the force of gravity through tension in said cable and maintaining the position of said load or moving said load by variation of the tension force applied to said cable, said stop mechanism comprising:

a secondary cable having a first end and a second end, said first end of said secondary cable being fastened to said load;

a rotatable idling drum, a portion of said secondary cable being wound around said drum;

tensioning means providing tension to said secondary cable to retard slippage between said drum and said cable;

braking means selectively engageable with said drum to retard rotation of said drum;

a first biasing means biasing said braking means away from engagement with said drum;

a second selectively engageable biasing means biasing said braking means towards engagement with said drum, said second biasing means exerting more force on said braking means than said first biasing means exerts on said braking means when said second biasing means is selectively engaged; and brake actuating means sensing magnitude of tension in said primary cable and selectively actuating said second biasing means in response to a predetermined decrease in tension along said primary cable;

whereby, in response to said predetermined decrease in tension along said primary cable, said brake actuating means actuates said braking means into engagement with said drum to retard the rotation of said drum and thereby retard the motion of said secondary cable so as to cause said secondary cable to exert a force on said load against the force of gravity.

2. The stop mechanism of claim 1 wherein said tensioning means comprises an idling pulley, said second end of said secondary cable being wound around said idling pulley and extending from said idling pulley to said load and being fastened to said load.

3. The stop mechanism of claim 2 wherein said tensioning means further comprises a spring disposed between said secondary cable and said load.

4. The stop mechanism of claim 1 wherein said braking means comprises a gear coupled to said drum and a pawl selectively movable into engagement with said gear, wherein said first biasing means biases said pawl away from engagement with said gear, and wherein said second biasing means biases said pawl towards engagement with said gear.

5. The stop mechanism of claim 4 wherein said selectively engageable second biasing means comprises:

an actuator movable from the first position away from said pawl to a second position against the said pawl; and a spring biasing said actuator against said pawl and in turn biasing said pawl into engagement with said gear.

6. The stop mechanism of claim 5 wherein said means selectively actuating said second biasing means comprises said primary cable and a pulley fastened to said load, said first cable being extended from said cable retracting means to and about said pulley and being extended from said pulley to said actuator, said primary cable biasing said actuator away from said pawl.

7. The stop mechanism of claim 1 wherein said selectively engageable second biasing means comprises:

an actuator movable from the first position away from said pawl to a second position against the said pawl; and a spring biasing said actuator against said pawl and in turn biasing said pawl into engagement with said gear.

8. The stop mechanism of claim 7 wherein said means selectively actuating said second biasing means comprises said primary cable and a pulley fastened to said load, said first cable being extended from said cable retracting means to and about said pulley and being extended from said pulley to said actuator, said primary cable biasing said actuator away from said pawl.

9. An emergency stop mechanism for a device for lifting a load resting on a load bearing member, said lifting device being capable of moving said load bearing member along a predetermined path against and with the force of gravity and having a primary cable and reel means operative to play out and take up said cable, said cable being fastened to said load bearing member and thus exerting a force on said load bearing member through tension in said cable opposing the force of gravity and moving said load in a direction of increased potential energy upon said primary cable being taken up by said reel, said stop mechanism comprising:

a secondary cable having a first end and a second end, said first end of said secondary cable being fastened to said load bearing member;

a rotatable cylindrical idling means having a line winding surface, a portion of said secondary cable being wound around said line winding surface;

tensioning means providing tension to said secondary cable to retard slippage between said line winding surface and said cable;

braking means selectively engageable with said idling means to retard rotation thereof;

a first biasing means biasing said braking means away from engagement with said drum;

a second selectively engageable biasing means biasing said braking means towards engagement with said drum, said second biasing means exerting more force on said braking means than said first biasing means exerts on said braking means when said second biasing means is selectively engaged; and brake actuating means sensing tension in said primary cable and selectively actuating said second biasing means in response to a predetermined decrease in tension along said primary cable;

whereby, in response to said predetermined decrease in tension along said primary cable, said brake actuating means actuates said braking means into engagement with said idling means to retard the rotation of said idling means and thereby retard the motion of said secondary cable so as to cause said secondary cable to exert a force on said load bearing member against the force of gravity.

10. The stop mechanism of claim 9 wherein said tensioning means comprises an idling pulley, said second end of said secondary cable being wound around said idling pulley and extending from said idling pulley to said load and being fastened to said load bearing member.

11. The stop mechanism of claim 9 wherein said tensioning means further comprises a spring disposed between said secondary cable and said load bearing member.

12. The stop mechanism of claim 9 wherein said braking means comprises a gear coupled to said drum and a pawl selectively movable into engagement with said gear, wherein said first biasing means biases said pawl away from engagement with said gear, and wherein said second biasing means biases said pawl towards engagement with said gear.

13. The stop mechanism of claim 12 wherein said selectively engageable second biasing means comprises:

an actuator movable from the first position away from said pawl to a second position against the said pawl; and a spring biasing said actuator against said pawl and in turn biasing said pawl into engagement with said gear.

14. The stop mechanism of claim 13 wherein said means selectively actuating said second biasing means comprises said primary cable and a pulley fastened to said load bearing member, said first cable being extended from said cable retracting means to and about said pulley and being extended from said pulley to said actuator, said primary cable biasing said actuator away from said pawl.

15. An emergency stop mechanism for a lifting device raising and lowering a first portion of a payload wherein said first portion of said payload is supported by said lifting device and a second portion of said payload is supported by the ground and wherein said lifting device comprises a trolley upon which said first portion of said payload rests, a first link member pivotally fastened at one of its ends to said trolley, a second link member pivotally fastened at one of its ends to a third portion of said payload intermediate said first and said second portions and the other end of its ends to the other end of said first link member, one of said link members being supported by the ground, a primary cable and reel means fastened to said second link member at a location intermediate said link members and operative to play out and take up said cable, said cable being fastened to said trolley and exerting a force on and said trolley through tension in said cable opposing the force of gravity, said cable moving said trolley in a direction of increased potential energy upon being taken up by said reel and drawing said one ends of said link members together, said stop mechanism comprising:

a secondary cable, a first end of said secondary cable being fastened to said trolley;

a rotatable idling drum, a second end of said secondary cable being wound around said idling drum;

tensioning means providing tension to said secondary cable to retard slippage between said idling drum and said cable;

braking means selectively engageable with said idling drum to retard rotation of said idling drum;

a first biasing means biasing said braking means away from engagement with said drum;

a second selectively engageable biasing means biasing said braking means towards engagement with said drum, said second biasing means exerting more force on said braking means than said first biasing means exerts on said braking means when said second biasing means is selectively engaged; and brake actuating means sensing the magnitude of the tension in said primary cable and selectively actuating said second biasing means in response to a predetermined decrease in tension along said primary cable, whereby, in response to said predetermined decrease in tension along said primary cable, said brake actuating means actuate said braking means into engagement with said idling drum to retard the rotation of said idling drum and thereby retard the motion of said secondary cable so as to cause said secondary cable to exert a force on said trolley opposing the force of gravity.

16. The stop mechanism of claim 15 wherein said tensioning means comprises an idling pulley, said second end of said secondary cable being wound around said idling pulley and extending from said idling pulley to said load and being fastened to said trolley.

17. The stop mechanism of claim 16 wherein said tensioning means further comprises a spring disposed between said secondary cable and said trolley.

18. The stop mechanism of claim 15 wherein said braking means comprises a gear coupled to said drum and a pawl selectively movable into engagement with said gear, wherein said first biasing means biases said pawl away from engagement with said gear, and wherein said second biasing means biases said pawl towards engagement with said gear.

19. The stop mechanism of claim 18 wherein said selectively engageable second biasing means comprises:

an actuator movable from the first position away from said pawl to a second position against the said pawl; and a spring biasing said actuator against said pawl and in turn biasing said pawl into engagement with said gear.

20. The stop mechanism of claim 19 wherein said means selectively actuating said second biasing means comprises said primary cable and a pulley fastened to said load, said first cable being extended from said cable retracting means to and about said pulley and being extended from said pulley to said actuator, said primary cable biasing said actuator away from said pawl.

21. The stop mechanism of claim 18 wherein said means selectively actuating said second biasing means comprises said primary cable and a pulley fastened to said load, said first cable being extended from said cable retracting means to and about said pulley and being extended from said pulley to said actuator, said primary cable biasing said actuator away from said pawl.

* * * * *